US007635238B2

(12) United States Patent
Colbert

(10) Patent No.: US 7,635,238 B2
(45) Date of Patent: Dec. 22, 2009

(54) DEVICE FOR PREVENTING DOCK PILING OR STRUCTURE PILING UPLIFT

(75) Inventor: Robert Colbert, Lindenhurst, NY (US)

(73) Assignee: Piling Anti-Lift Systems, Lindenhurst, NY (US)

( * ) Notice: Subject to any disclaimer, the term of this patent is extended or adjusted under 35 U.S.C. 154(b) by 1028 days.

(21) Appl. No.: 10/842,590

(22) Filed: May 10, 2004

(65) Prior Publication Data

US 2005/0249556 A1 Nov. 10, 2005

(51) Int. Cl.
*E02D 5/60* (2006.01)

(52) U.S. Cl. ..... 405/216; 405/217; 392/304; 219/636

(58) Field of Classification Search ..... 405/211–212, 405/216; 219/535; 392/301–305
See application file for complete search history.

(56) References Cited

U.S. PATENT DOCUMENTS 934,176 A * 9/1909 Hubbard ..... 405/216
D139,313 S * 10/1944 Landerman ..... D23/323
2,484,063 A * 10/1949 Ackley ..... 392/304
3,180,099 A * 4/1965 Mikolajczyk et al. ..... 405/216
3,609,980 A * 10/1971 Bowers ..... 405/232
3,757,086 A * 9/1973 Indoe ..... 219/528
4,127,002 A * 11/1978 DeWitt ..... 405/239
4,403,459 A * 9/1983 Hurlbut ..... 52/103
4,464,083 A * 8/1984 Wathey ..... 405/216
4,512,683 A * 4/1985 Cosenza ..... 405/216
4,585,681 A * 4/1986 Kidera et al. ..... 405/231
4,784,526 A * 11/1988 Turner ..... 405/204
4,791,277 A * 12/1988 Montierth et al. ..... 219/535
4,818,148 A * 4/1989 Takeda et al. ..... 405/234
4,908,501 A * 3/1990 Arnold, III ..... 219/438
5,211,223 A * 5/1993 Mulville ..... 166/60
5,326,410 A * 7/1994 Boyles ..... 156/71
5,676,872 A * 10/1997 Garcia-Rodriguez ..... 219/549
D415,264 S * 10/1999 Thweatt, Jr. ..... D23/323
6,260,615 B1 * 7/2001 Dalrymple et al. ..... 166/60
6,663,453 B2 * 12/2003 Quigley et al. ..... 441/133

* cited by examiner

*Primary Examiner*—Tara Mayo-Pinnock
(74) *Attorney, Agent, or Firm*—Tutunjian & Bitetto, P.C.

(57) ABSTRACT

A device for preventing dock piling or structure piling uplift includes a tubular member concentrically disposed around the piling so as to form an annular space between the tubular member and the piling. A heating element is disposed within the tubular member and connected to a power source. The heating element prevents the water or ground within the annular space from freezing to a point where it adheres to the piling and shifts the same upward in response to changing tides or ground shifts in cold weather.

6 Claims, 4 Drawing Sheets

DEVICE FOR PREVENTING DOCK PILING OR STRUCTURE PILING UPLIFT

FIELD OF THE INVENTION

The present invention relates to a device for preventing dock piling and/or structure piling uplift caused by frost heaving or shifting.

BACKGROUND OF THE INVENTION

U.S. Pat. No. 4,127,002 relates to a permanent pier piling for use in docks and the like in a body of water whereby an antifreeze solution within the piling circulates to distribute latent ground heat from the lower portion of the piling to the upper portion of the piling to maintain a fluid interface between the piling and the ice during the winter season.

U.S. Pat. No. 4,464,083 relating to an ice guard for protecting a vertically extending piling positioned in a body of water from damage due to changes in water and ice levels. The ice guard is concentrically positioned around a piling and extends above the surface of the body of water. The ice guard is held in place by the surrounding ice. The ice guard includes at least one longitudinally extending sleeve which is made of a buoyant material and a means for restricting vertical movement of at least a portion of the sleeve. Various longitudinally extending ribs can radiate from the sleeve to enhance adhesion of the sleeve to the ice.

U.S. Pat. No. 4,818,148 relates to a covering applied on the outer surface of a pile including a steel pipe or the like to surround a predetermined length thereof so as to reduce frost heaving force or negative friction acting on the pile in a frigid area. The covering is closely adhered by an adhesion layer to the pile.

U.S. Pat. No. 4,585,681 relates to a frost damage proofed pile for installment in a frigid district where the pile is subjected to a freezing and frost heaving force, such as permanently or seasonally frozen soil terrain. A tubular sheath member is fitted over the pile surface and has a length longer than the thickness of an active or seasonally frozen soil layer of the terrain in which the pile is installed. At least a portion of the length of the pile is formed as an extensible section, and at least the lower end of the sheath member is secured to the pile at or below a position corresponding to the bottom region of the active or seasonally frozen soil layer. A fluid material is filled in a space defined between the pile and the sheath member. The frost heaving force caused to exist upon freezing of the active or seasonally frozen soil layer as well as negative friction caused to exist in summer are inhibited from affecting the pile due to sliding of the sheath member relative to the pile.

U.S. Pat. No. 4,512,683 relates to a sleeve adapted to float in water to surround a piling to protect the same from being lifted by ice. It includes an outer corrugated casing which can be easily gripped by ice forming therearound. Within the casing is a layer of waterproof cementitious material followed by a layer of closed cell foam plastic. The innermost surface of the sleeve, which faces the piling, is a smooth even layer of polyethylene film. Should ice form in the annular space between the piling and the sleeve, the sleeve can easily slide up or down across the outer surface of the ice without moving the piling.

U.S. Pat. No. 4,403,459 relates to a method and apparatus for installing a benchmark in an arctic region to provide a reference point even after prolonged periods of exposure. To install the benchmark, a hole is formed through the active layer and into the underlying layer. An alignment jig mounts a marker element in a casing and both are positioned into the hole. A leveling clamp on the casing is used to plump and adjust the marker element to a known elevation. The marker element extends to the bottom of the hole while the casing terminates at a depth which is above the bottom of the hole but below the bottom of the active layer. A settable material which will freeze at ambient conditions, is poured into the hole to a point just above the lower end of the casing and is allowed to set. The annulus within the casing around the marker element is filled with fluidic material which will not freeze under ambient conditions. Since the marker element does not directly contact any part of the active layer, the marker element is effectively isolated from contact therewith so that the thawing and refreezing of the active layer do not disturb the position or elevation of the benchmark.

U.S. Pat. No. 4,784,526 relates to an arctic offshore platform placed in shallow waters with low to moderate ice environments. The arctic offshore platform has one or more support legs. Each support leg includes a base resting on the ocean floor, a central support column extending upward through the base to a portion above the ocean surface and a sloped-sided member seated atop the base and extending upward around the central support column to a position above the ocean surface. The base and central support column are installed and secured to the ocean floor as a unit. The sloped sided member is secured atop the base. The sloped sided member causes the ice sheets which may impact the support leg to fail in flexure, thus reducing the overall ice loadings in the support leg relative to the loading which would exist were the sloped-sided member absent.

SUMMARY OF THE INVENTION

The present invention relates to a system and method for preventing dock pilings from uplifting due to frozen water and tidal changes and land structure pilings in ground. It is an object of the present invention for the product to slide over the pilings and float partially above the water line. It is an object of the present invention for the device to float approximately 25% above the water line. The present invention comprises a power cord which is wrapped around a piling and plugged into a power source. It is an object of the present invention for the power source to be a 110 volt shore power. It is an object of the present invention for the power source to be located at the dock. The power cord supplies power to a heat trace cable which is enclosed in an air-tight sealed hose. The heat from the trace cable prevents the piling from freezing to the ice beyond the exterior of the heated hose. It is an object of the present invention for the water between the hose and the piling not to freeze. It is an object of the present invention for the internal ice to remain independent from the exterior ice. It is an object of the present invention to keep the piling independent from the strength of the vertical ice.

It is an object of the present invention for the heated hose to keep the piling independent from the force of the rising tide. This prevents upward lift.

It is an object of the present invention to provide a rigid hose. It is an object of the present invention for the heated hose to be attached to a plastic tube. It is an object of the present invention for the plastic tube to be about 4 feet long. It is an object of the present invention for the plastic tube or pipe to be about 10"-15" in diameter.

The present invention relates to a method of protecting a piling against uplifting comprising: installing a heat trace cable inside a hose. The hose is then sealed air tight. The air tight seal allows for buoyancy of the device. Both sealed ends of the heated hose will remain above the water line or ground line. One end of the hose is capped closed, while the other end is sealed with the power cord that is plugged into the shore power. It is an object of the present invention to provide a thermostat adapter.

It is an object of the present invention for the device to be the flexible type. Tt is an object of the present invention for the device to protect any size piling or joined pilings. It is an object of the present invention for the device to be installed on pilings attached to docks or on land structures. It is an object of the present invention for the heat hose to be wrapped around the piling or joined pilings. It is an object of the present invention for the flexible heated hose to be wrapped around the piling without disturbing any hardware.

It is an object of the present invention to provide a device for preventing pilings from shifting or lifting in the frozen ground. The present invention relates to a device which prevents land pilings from uplifting due to frost heaving or shifting comprising a power cord which is wrapped around a piling and plugged into a power source. It is an object of the present invention for the device to be located 25% above the ground.

DETAILED DESCRIPTION OF THE INVENTION

Figure 1:
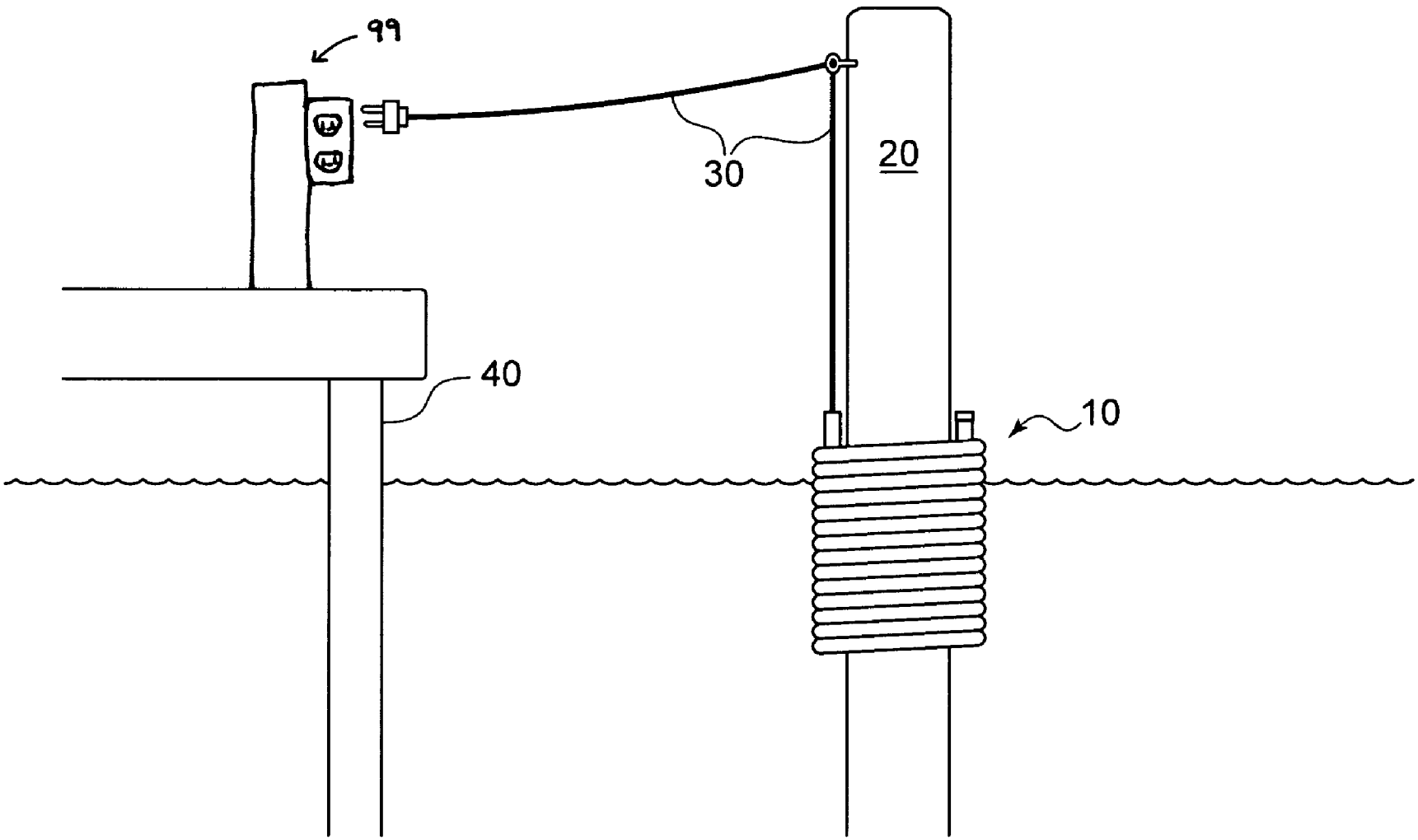
FIG. 1 is a side view of the device of the present invention wrapped around a dock piling.

FIG. 1 shows the device 10 slid over the piling 20 and floating approximately 25% above the water line, and 75% below the water line. The power cord 30 is plugged into a 110 volt shore power 99 on the dock 40. The power cord 30 supplies power to a heat trace cable 67 which is enclosed in an air-tight sealed hose. The heat from the heat trace cable 67 prevents the piling from freezing to the ice beyond the exterior of the heated hose.

Figure 2:
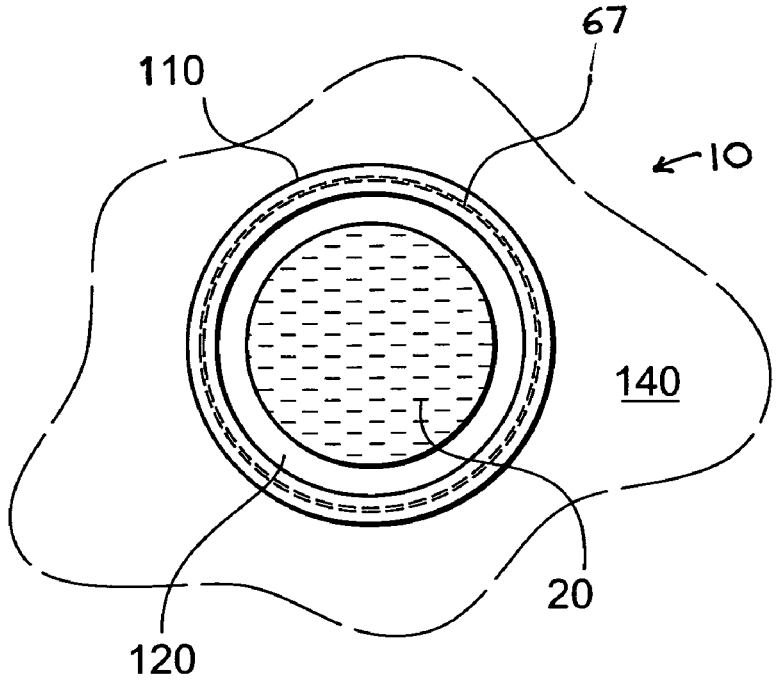
FIG. 2 is a top view showing the device of the present invention wrapped around a dock piling.

FIG. 2 shows a top view of the device 10 which has a heated hose 110. Using the device of the present invention the water 120 between the hose 110 and the piling 20 does not freeze. Ice may begin to form at the water's surface, from the piling 20 toward the interior of the heated hose 110, but the internal ice/water 120 remains independent from the exterior ice 140. The device of the present invention keeps the piling independent from the massive strength of the vertical ice movement While the tide may rise and fall when ice is attached to the piling 20, the heated hose 110 keeps the piling 20 independent from the force of the rising Tide. This prevents any upward lift.

Figure 3:
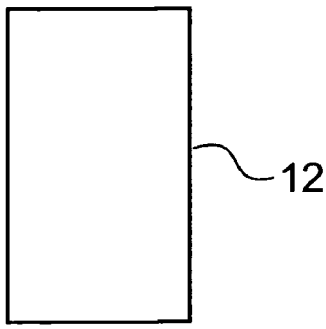
FIG. 3 shows a plastic tube or plastic pipe used in the device of the present invention.
Figure 4:
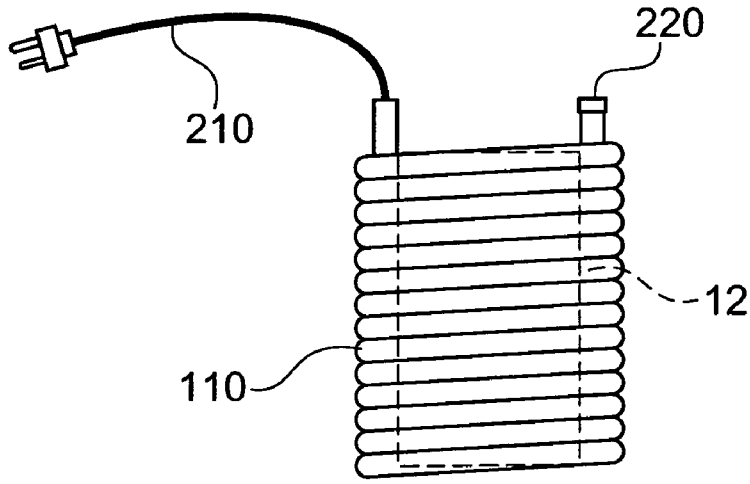
FIG. 4 shows the device of the present invention.

FIG. 3 shows an embodiment of a rigid type, wherein the heated hose is attached to a plastic tube or plastic pipe 12 which is approximately 4 feet long and 10"-15" in width, FIG. 4 shows the tube 12 having the power cord 210 inside of it. In a preferred embodiment, the tube stays 25% above the water line and 75% below the water line.

First the heat trace cable 67 is installed inside the hose. The hose 110 is then sealed, one end capped 220, and the other end will have the power cord 210 that will be plugged into the shore power 99. The air-tight seal allows for the buoyancy of the product. Both sealed ends of the heated hose, and the heat trace cable 67, will remain above the water line. The heated hose is then wrapped around the tube. The unit is then ready for installation. In a preferred embodiment, thermostat adapter plugs are available.

Figure 5:
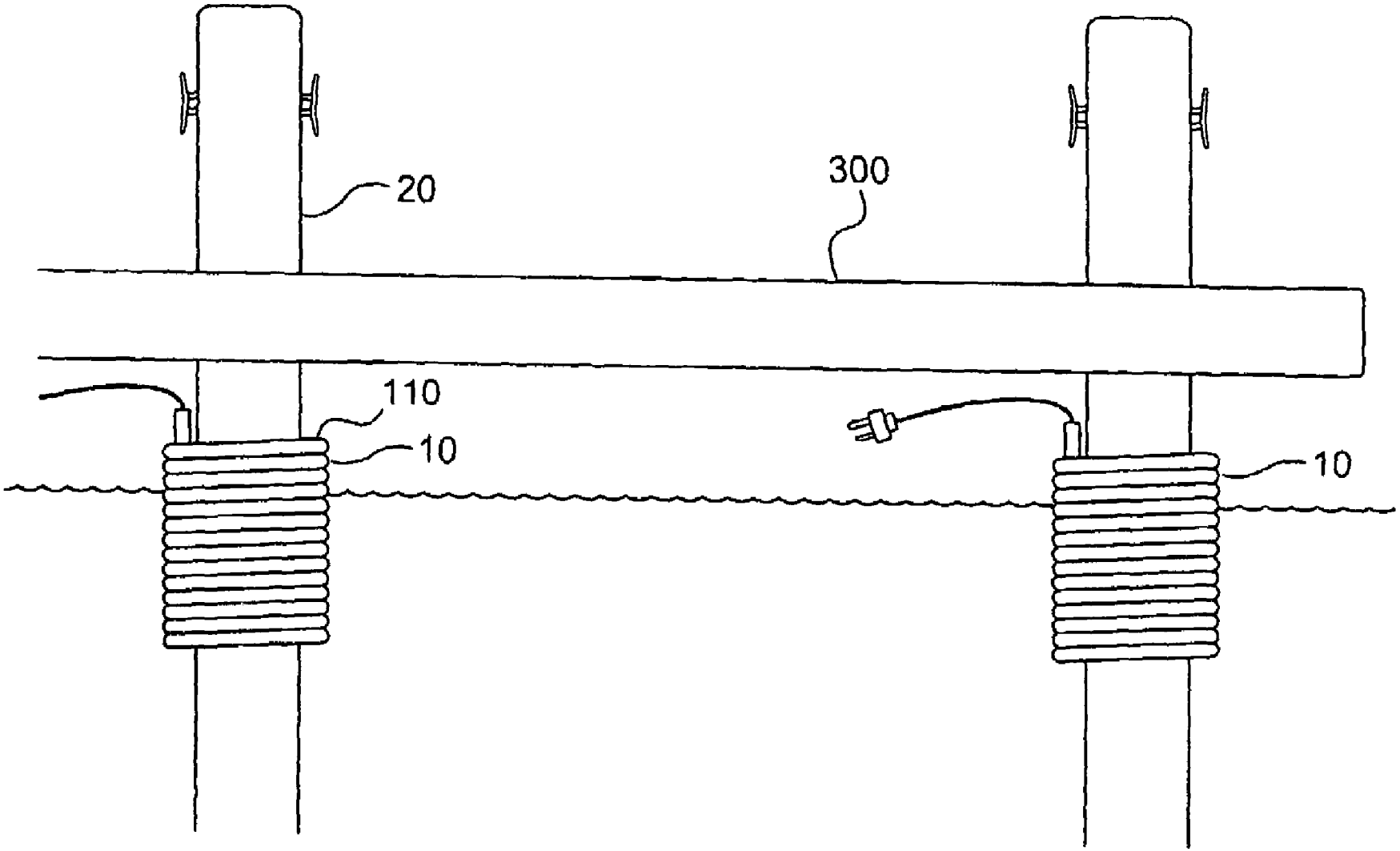
FIG. 5 shows a side view showing multiple devices of the present invention used on a dock.

FIG. 5 shows a side view of a floating dock or boardwalk 300, showing multiple devices 10. FIG. 5 shows an embodiment wherein the devices 10 are flexible. With the flexible type, the user has the advantage of protecting any size piling or joined pilings 20. The flexible type allows installation on pilings attached to docks. With the flexible type, the heated hose 110 can simply be wrapped around the piling 20, or joined pilings. Many pilings at boat slips have hardware mounted to them. In this case, the flexible heated hose can be wrapped around the piling without disturbing the hardware.

Figure 6:
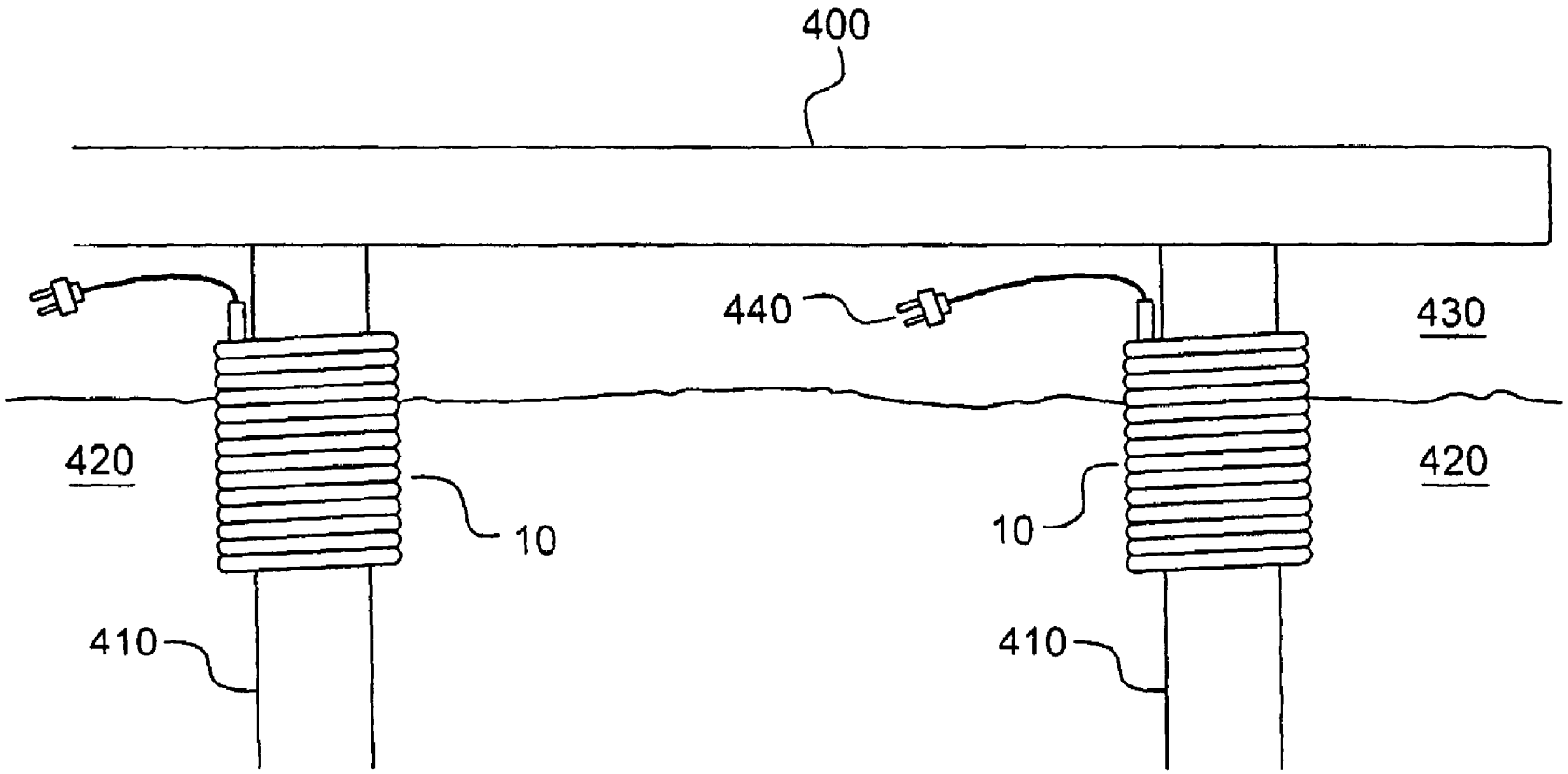
FIG. 6 shows a side view showing multiple devices of the present invention used for land pilings.

FIG. 6 shows a side view of a bottom support beam or structure 400 having multiple devices 10 attached to land pilings 410. The device 10 preferably is approximately 75% below the ground 420 and 25% above the ground in the crawlspace 430. Plug 440 is attached to a device for providing power to the device 10.

The invention claimed is:

1. A device for preventing pilings disposed in water from uplifting due to frozen water and tidal changes comprising:

a tubular member having a diameter larger than that of the piling, said tubular member being disposed in the water around the piling such that an annular space of water exists between the tubular member and the piling; and a heat cable secured to said tubular member and connected to a power source, said tubular member with said heat cable maintaining the piling independent from rising frozen tide waters, said heat cable having both ends that remain above a water line.

2. The device of claim 1, wherein said tubular member floats partially above a water line.

3. The device of claim 1, further comprising a power cord connected to one of said ends of said heat cable, said power cord being connected to the power source, wherein said power source is a 110 volt shore power.

4. The device of claim 3, wherein said device substantially prevents water in the annular space between said tubular member and said piling from freezing.

5. The device of claim 1, wherein said power source is located remote from the piling.

6. A method for protecting a piling against uplifting comprising:

providing a tubular member to be disposed around the piling, said tubular member having a diameter larger than a diameter of the piling, said tubular member being spaced from the piling so as to form an annular spacing between the tubular member and the piling;

wrapping a heat cable around said tubular member, said wrapping further comprising disposing the heat cable in an air-tight sealed hose and wrapping the hose around said tubular member, said heat cable having both ends disposed above a water line; and connecting one end of the heat cable to a power source above the water line;

wherein said tubular member with said heat cable maintains the piling independent from freezing ground or water surrounding the piling.

* * * * *